US006782837B1

(12) United States Patent
Orii et al.

(10) Patent No.: US 6,782,837 B1
(45) Date of Patent: Aug. 31, 2004

(54) SEWING MACHINE WITH PATTERN INDICATING DEVICE

(75) Inventors: Akira Orii, Tokyo (JP); Moriyoshi Shibata, Tokyo (JP)

(73) Assignee: Janome Sewing Machine Co., Ltd., Tokyo (JP)

( * ) Notice: Subject to any disclaimer, the term of this patent is extended or adjusted under 35 U.S.C. 154(b) by 0 days.

(21) Appl. No.: 10/722,871

(22) Filed: Nov. 26, 2003

(30) Foreign Application Priority Data

Dec. 27, 2002 (JP) ..... 2002-379626

(51) Int. Cl.[7] ..... D05B 3/02
(52) U.S. Cl. ..... 112/445; 112/454
(58) Field of Search ..... 112/445, 454, 112/456, 457, 458, 102.5, 470.06

(56) References Cited

U.S. PATENT DOCUMENTS 4,266,493 A * 5/1981 Hanyu et al. ..... 112/454
4,499,836 A * 2/1985 Meier et al. ..... 112/445
4,860,678 A * 8/1989 Skogward ..... 112/470.04

* cited by examiner

*Primary Examiner*—Peter Nerbun
(74) *Attorney, Agent, or Firm*—Nields & Lemack

(57) ABSTRACT

Disclosed is a sewing machine having an indicating device for indicating selected patterns in a manner that the same may be substantially the same with the actually stitched result of the selected patterns, wherein the patterns selected by a user by operation of a pattern selecting/combining device 3 are indicated at an indicating device 8 and wherein in response to an optional combination or modification of the selected patterns, an image treating device 7 accordingly treats the image of the indicated patterns to indicate the same at the indicating device 8. The pattern data are stored in a pattern data memory 50 and a stitching mechanism 51 is operated in accordance with the pattern data stored in the pattern data memory 50, thereby to form the patterns of stitches.

8 Claims, 4 Drawing Sheets

SEWING MACHINE WITH PATTERN INDICATING DEVICE

BACKGROUND OF THE INVENTION

1. Field of the Invention

The present invention relates to a sewing machine and more particularly relates to a sewing machine having an indicating device which is electrically operated to indicate a plurality of selected patterns arranged to be stitched in combination.

2. Related Art

Now a sewing machine having a zigzag stitching function for forming the patterns of zigzag stitches is available in the market and is widely used. Such a sewing machine is generally provided with an indicating device for indicating the patterns selected by the user for confirmation at the time of stitching the selected patterns.

The pattern data for stitching patterns are generally formed up in consideration of the difference in efficiency of circular arc movement of machine needle and of forward and reverse movement of a work feeding mechanism. It is, therefore, unavoidable that the pattern data indicated as being in the indicating device will be different from the actually stitched result of the patterns. Therefore, the indication data for indicating patterns are generally prepared by using the bit map data for each of the patterns to be selectively stitched.

SUMMARY OF THE INVENTION

However, in the recent years, the sewing machine has come to have many functions including optional combination of patterns, optional enlargement and reduction of patterns and so on. In fact, the conventional indicating function is not sufficient for satisfying such variation of patterns to be stitched.

For example, in case the patterns are to be stitched in combination, the patterns are not indicated in a combined state, but are indicated individually. Further, in case the patterns are optionally enlarged or reduced by the user, the patterns indicated will remain as unchanged.

The invention has been provided to eliminate such defects and disadvantages of the prior art.

For attaining the object, the invention has been made in connection with a sewing machine for stitching optionally selected patterns in accordance with pattern data, and the sewing machine comprises a means for giving indication data for said pattern data, a means for arranging said indication data in accordance with a combination of said pattern data, a means for changing said indication data in accordance with the change of said pattern data, a means for indicating said indication data in a manner that said indication data may be scrolled, a means for designating an initial one of the pattern data indicated at said indicating means.

With the combination of elements, in case the patterns are optionally combined, the indication data is indicated in accordance with the combined patterns and may be changed in accordance with change of the pattern data. Such indication data as indicated will be confirmed by the machine user as being the same with the stitched result of patterns which are selected to be stitched. Further, since the means for indicating the indication data may be so formed as to scroll the indicated patterns, all of the patterns may be indicated even if a series patterns to be indicated are beyond the indication area of the indicating device. Further, with a means provided to designate the pattern data to be changed at the indication surface of the indicating means, the machine user may change the pattern data while the user is watching the indication data.

Further, according to the invention, in case the same patterns are combined linearly, the same patterns may be indicated in series while the image treatment is performed, wherein the stitch end point of indication data for the pattern data preceding the next indication data for the next pattern data is made to be a stitch start point of the next indication data for the next pattern data. Therefore, the actually indicated patterns may be substantially the same with the patterns to be actually stitched.

Further, according to the invention, in case the pattern data preceding the initial pattern data for the patterns indicated at the indicating means is the same with the initial pattern data, it is discriminated whether or not the initial pattern data overlaps the preceding pattern data. In case it is discriminated that the initial pattern data overlaps the preceding pattern data, the image treatment is started from the preceding pattern data so that the overlapped portion of pattern data may be indicated at the indicating means.

DETAILED DESCRIPTION OF THE PREFERRED EMBODIMENTS

The invention will be described in reference to the attached drawings.

Figure 1:
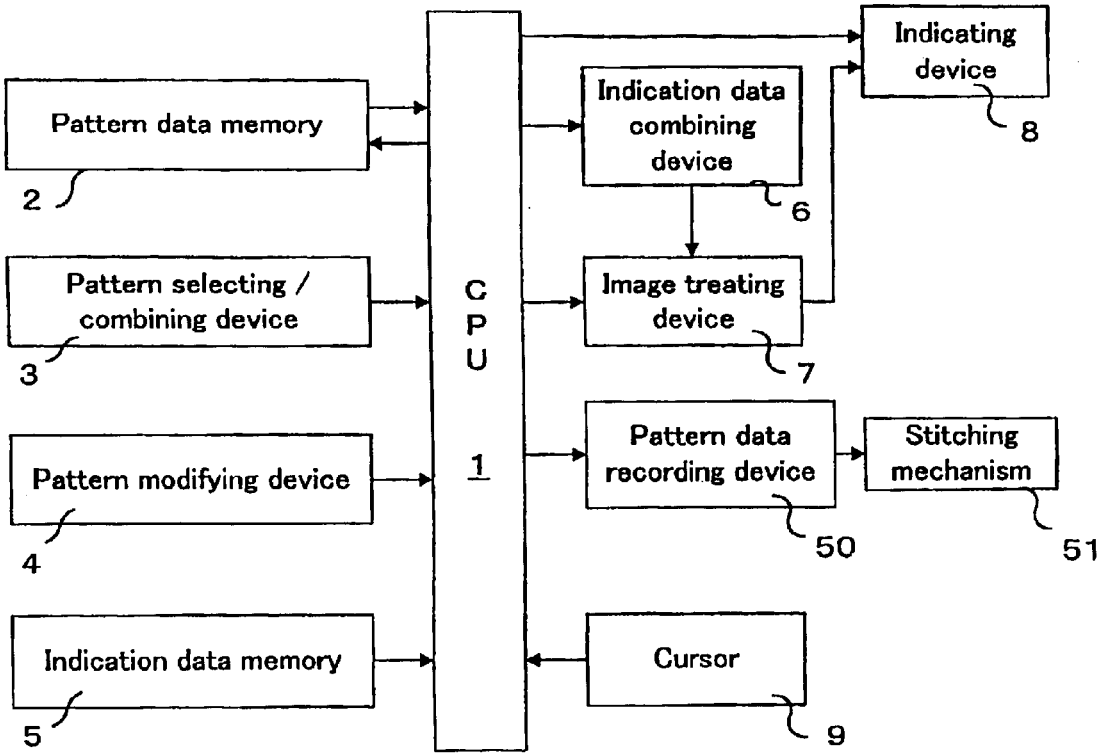
FIG. 1 is a block diagram showing the embodiment of the invention.

In FIG. 1, a CPU 1 including a microcomputer is provided to control the essential parts of a sewing machine. A pattern data memory 2 has the stitch data of predetermined zigzag patterns stored therein and is connected to the CPU 1. An indication data memory 5 has the indication data stored therein as corresponding to the patterns stored in the pattern data memory 2 and is connected to the CPU 1.

A pattern selecting/combining device 3 is provided so as to be operated by a machine user to select one or a plurality of patterns in combination from the patterns stored in the pattern data memory 2. A pattern modifying device 4 is provided so as to be operated by a machine user to modify, for example, to reduce, enlarge or reverse the selected pattern or patterns.

A pattern indicating device 8 is provided to indicate thereat the pattern or patterns selected by the pattern selecting/combining device 3 so that the indicated pattern or patterns may be confirmed by the machine user.

An indication data combining device 6 is provided to form up a list therein of the patterns which are selected in combination. An image treating device 7 is provided to treat the image of combined patterns in accordance with the pattern list so that the treated image of patterns may be indicated at the pattern indicating device 8.

In case the selected pattern or patterns are to be modified, a pattern modifying signal is transmitted to the image treating device 7 so that the modified image of a pattern or patterns in combination may be indicated at the pattern indicating device 8.

A cursor device 9 is provided which is operated with operation of a button or the like by the machine user to indicate a cursor at the indicating device 8 so that the cursor may be used to point to an optional one of the patterns indicated at the pattern indicating device 8. The cursor may be pointed to a pattern which is to be indicated at an initial position or which is to be modified.

The pattern data selected, combined and modified by the pattern selecting/combining device 3 is recorded in a pattern data recording memory 50. A stitching mechanism 51 is operated to perform a stitching operation in accordance with the pattern data recorded in the pattern data recording memory 50.

As is described hereinbefore, the indication data combining device 6 will operate to form up a list of indication data in reference to the indication data stored in the indication data memory 5 in accordance with the patterns combined by the pattern selecting/combining device 3, and the image treating device 7 will produce the indication data on the basis of the indication data list so that the indication data corresponding to the combined patterns to be stitched may be indicated at the indicating device Further, in response to a pattern modifying signal, the image treating device 7 will produce new indication data on the basis of the indication data stored in the indication data memory 5 so that a modified pattern may be indicated at the indicating device 8.

Figure 2:
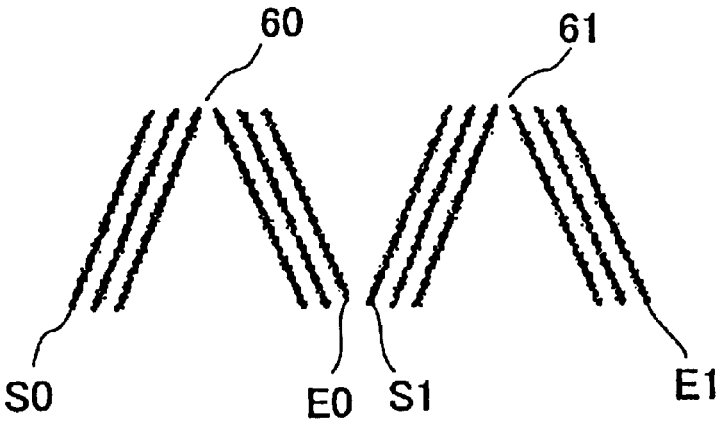
FIG. 2 is an explanatory view showing the operation of the embodiment of the invention.
Figure 3:
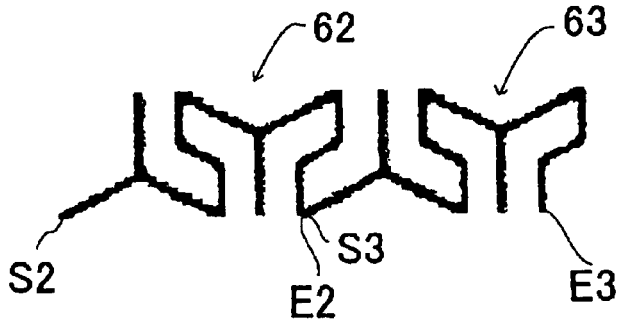
FIG. 3 is another explanatory view showing the operation of the embodiment of the invention.
Figure 4:
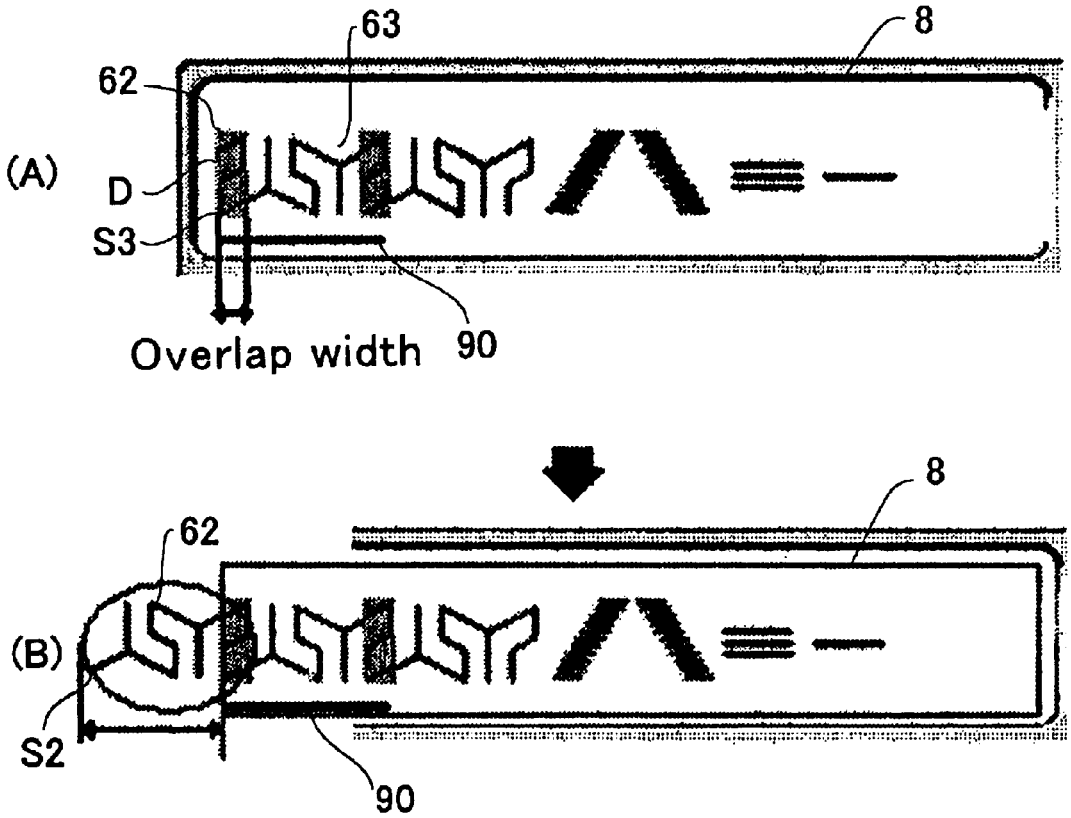
FIG. 4(A) is an explanatory view showing the operation of the embodiment of the invention in connection with FIG. 3.
FIG. 4(B) is an explanatory view showing the operation of the embodiment of the invention in connection with FIG. 4(A).

According to the embodiment, the combined patterns are indicated as arranged linearly from left to right as shown in FIGS. 2 through 4. The image treating device 7 will treat the image of patterns so as to be continuous to one another in case the patterns are of an identical type.

FIG. 2 shows that a pattern 60 and a pattern 61 are in a combined state. In this case, the stitch end point E0 of the pattern 60 may be indicated as the stitch start point S1 of the pattern 61.

However as shown in FIG. 3, in case a pattern 62 is repeatedly stitched in series wherein the stitch end point E2 is not at the end of the pattern and terminates at a stitch start point S2, it becomes necessary to make a special treatment of pattern image. More precisely, as shown in FIG. 4, in case the second pattern 63 of the same pattern is indicated in the first position at the pattern indicating device 8, it becomes necessary to indicate a portion D of the pattern 62 which overlaps the stitch start point S3 of the pattern 63.

Figure 5:
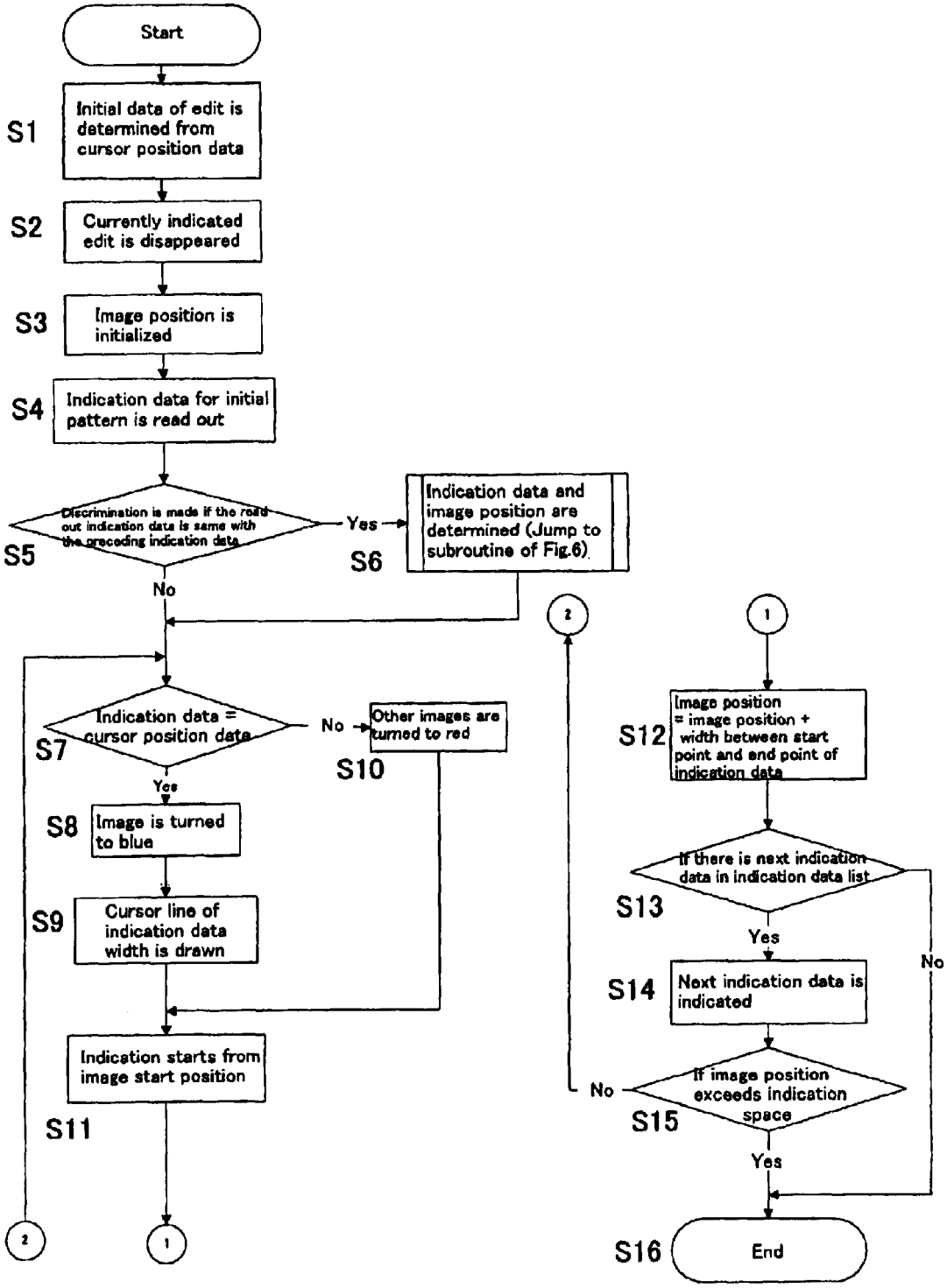
FIG. 5 is a flow chart showing the operation of the embodiment of the invention.

The indication may be realized by a special treatment of pattern image as follows:

In FIG. 5, when the first pattern is selected, the initial data is decided from the position data of a cursor so that a cursor 90 may come to an optional position in the indicating device 8 while the currently indicated data is disappeared, and then the pattern image position is initialized (Steps S1, S2, S3). Subsequently the indication data for the initial pattern is read out (step S4). Subsequently it is determined whether or not the read out indication data is identical with the preceding indication data (step S5). In case the read out indication data is identical with the preceding indication data, the image treatment jumps to the subroutine (FIG. 6) (step S6). In case the read out indication data is not identical with the preceding indication data, the pattern which is at the cursor position is turned to blue and a cursor line is drawn (steps S7, S8, S9) while the other patterns are treated to turn to red (step S10), and then the indication of pattern is started from the pattern image start position (step S11). Subsequently, the width between the pattern indication start point and the pattern indication end point of the pattern indication start data is needed to the pattern image position to make the next indication start point (step S12). Subsequently it is checked whether or not the next data exists in the list (step S12). In case the next data exists, the indication of the next indication data is carried out (step S14). In this case, it is checked whether or not the indicating area of the pattern indicating device 8 remains to be further available (step S15). In case there is no indicating area remaining available, the image treatment is finished. In case the indicating area remains, the image treatment returns to step S7 and the same operation is repeated.

Figure 6:
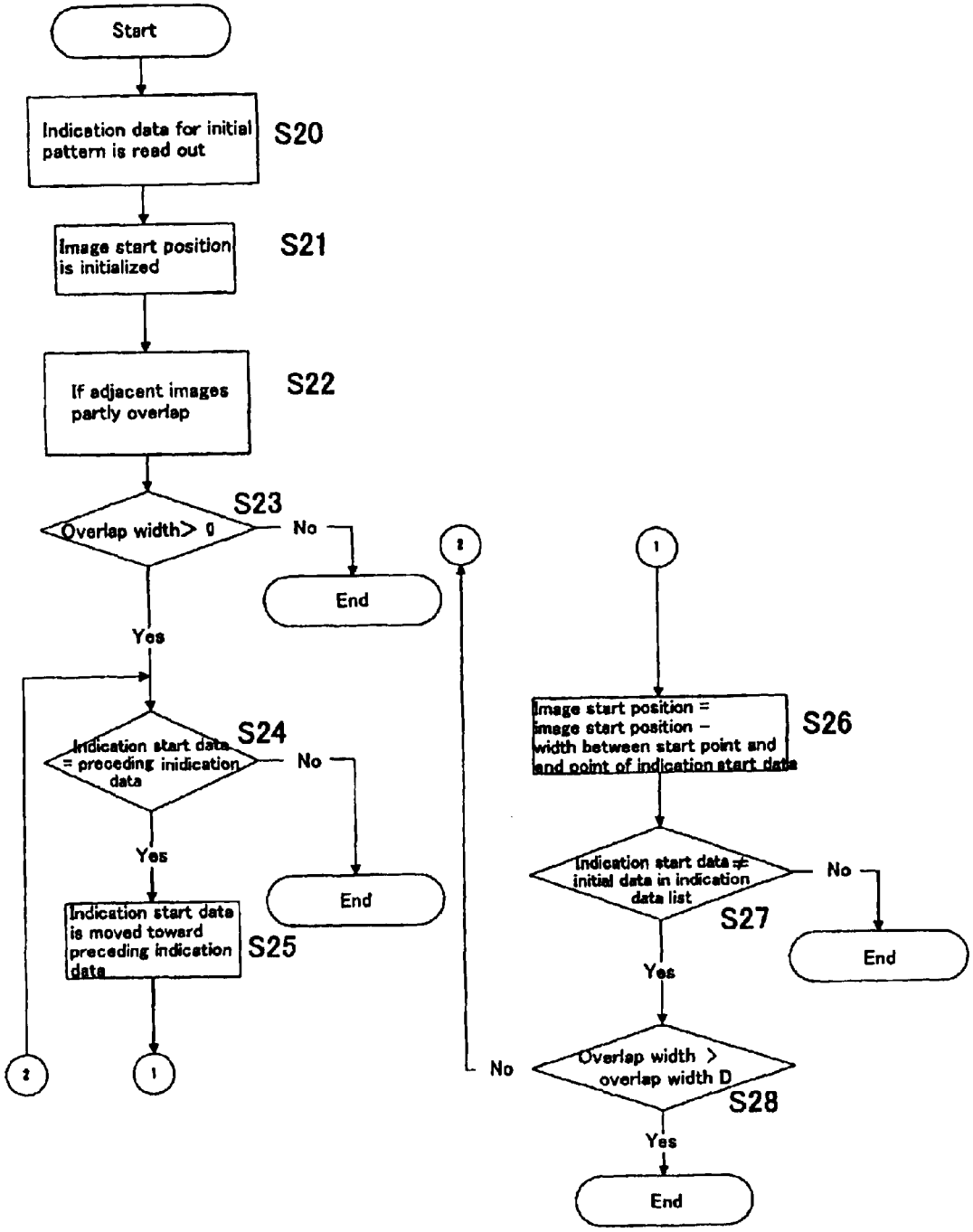
FIG. 6 is a flow chart showing the operation of the embodiment of the invention in connection with FIG. 5.

The pattern image treatment at the step S6 will be described in reference to FIGS. 4 and 6.

The indication data for the initial pattern 63 is read out (step S20) and the pattern image start position is initialized (step S21). Then as shown in FIG. 4, it is discriminated whether or not there is the portion D overlapping the preceding pattern (steps S22, S23). In case there is no overlapping portion, the image treatment comes to end. In case there is an overlapping portion, it is discriminated whether or not the preceding pattern 62 is identical with the currently indicated pattern 63 (step S24). In case the preceding pattern is not identical with the currently indicated pattern, the image treatment comes to end. In case the preceding pattern is identical with the currently indicated pattern, the indication data for the preceding pattern 62 is set as a pattern image start data (step S25) and the pattern image start position is displaced to the pattern image start point S2 of the preceding pattern 62 by the data width (step S26). In case the pattern image start data is the initial data of the pattern list, the image treatment comes to end (step S27). In case the width of the pattern image start position fails to exceed the overlap width D, it becomes necessary to further displace the pattern image start position. In this case, the image treatment is returned to the step start point S24 (step S28).

As is described above, provided that at the step S26, image treatment is started from the pattern 62 while the pattern 63 is indicated as the initial pattern at the pattern indicating device 8, the overlap portion D at the end part of the preceding pattern 62 may be properly indicated at the pattern indicating device 8 as shown in FIG. 4.

In case a plurality of optionally selected patterns are stitched in combination, the indication data for the patterns may be indicated at the indicating device and may be changed in accordance with the change of the selected patterns. Thus the machine user may confirm the patterns to be stitched before starting the stitching operation of the patterns.

The invention being thus described, it will be obvious that the same may be varied in many ways. Such variations are not to be regarded as a departure from the spirit and scope of the invention, and all such modifications are intended to be included within the scope of the following claims.

What is claimed is:

1. A sewing machine for stitching optionally selected patterns in accordance with pattern data, the sewing machine comprising;

a means for giving indication data for said pattern data, a means for arranging said indication data in accordance with a combination of said pattern data, a means for changing said indication data in accordance with the change of said pattern data, a means for indicating said indication data in a manner that said indication data may be scrolled, a means for designating an initial one of the pattern data indicated at said indicating means.

2. The sewing machine as defined in claim 1, further comprising a means for designating one or more of the patterns at said indicating means, the pattern data of said one or more of the patterns to be changed.

3. The sewing machine as defined in claim 1, wherein said indication data are arranged in a linear combination and wherein said indicating means indicates the linearly combined patterns in a manner that the same may be scrolled in accordance with the indication data thereof.

4. A sewing machine for stitching optionally selected patterns in series in accordance with pattern data, the sewing machine comprising;

a means for giving indication data for said pattern data, a means for arranging said indication data in accordance with a predetermined linear combination of said pattern data, a means for indicating the linearly combined patterns in a manner that the same may be scrolled in accordance with said indication data, a means for discriminating whether or not the pattern data indicated in linear combination is identical with preceding pattern data, a means for treating the image of the patterns indicated at said indicating means, said image treating means treating the stitch end point of the indication data for said preceding pattern data so that said stitch end point may be indicated in series at said pattern indicating means as the stitch start point of the indication data for the next pattern data, in case said preceding pattern data is discriminated as identical with said next pattern data.

5. The sewing machine as defined in claim 4, further comprising a second discriminating means for discriminating whether or not the initial pattern data of said indicated combination of pattern data overlaps the preceding pattern data, in case said preceding pattern data is discriminated by said first discriminating means as identical with said initial pattern data, wherein in case said second discriminating means discriminates said initial pattern data overlapping said preceding pattern data, said image treating means is operated to treat said preceding pattern data in a manner that the overlap portion may be indicated at said pattern indicating means.

6. The sewing machine as defined in claim 4, further comprising a means for designating one or more of the patterns at said indicating means, the pattern data of said one or more of the patterns to be changed.

7. An indicating method of a sewing machine for stitching a plurality of patterns in series in accordance with pattern data, said indicating method comprising the steps of;

giving indication data for the corresponding pattern data, linearly combining said indication data in accordance with a predetermined linear combination of said pattern data, discriminating whether or not the pattern data of said linearly combined pattern data is identical with the preceding pattern data, treating the image of the patterns to be indicated in a manner that the stitch end point of the indication data corresponding to said preceding pattern data may be a stitch start point of the indication data corresponding to the next pattern data, in case said preceding pattern data is discriminated identical with the next pattern data, indicating said image treated indication data in series in a manner that the indicated indication data may be scrolled.

8. The indicating method of a sewing machine as defined in claim 7, further comprising a step of discriminating whether or not the initial pattern data of said linearly combined pattern data is identical with the preceding pattern data, and further discriminating whether or not said initial pattern data partly overlaps said preceding pattern data, in case said initial pattern data is discriminated identical with said preceding pattern data, wherein image treatment is performed starting from said preceding pattern data in accordance with the indication data so that the pattern images may be indicated with the overlap portion included, in case said initial pattern data is discriminated as partly overlapping said preceding pattern data.

* * * * *